US011692739B2

(12) United States Patent
Park et al.

(10) Patent No.: US 11,692,739 B2
(45) Date of Patent: Jul. 4, 2023

(54) FLOW CHANNEL CAP PLATE AND COMBUSTION CHAMBER ASSEMBLY INCLUDING THE SAME

(71) Applicant: KYUNGDONG NAVIEN CO., LTD., Gyeonggi-do (KR)

(72) Inventors: Jun Gil Park, Seoul (KR); Jung Yul Bae, Seoul (KR); Seong Sik Moon, Seoul (KR); In Chul Jeong, Seoul (KR)

(73) Assignee: Kyungdong Navien Co., Ltd., Gyeonggi-do (KR)

( * ) Notice: Subject to any disclaimer, the term of this patent is extended or adjusted under 35 U.S.C. 154(b) by 0 days.

(21) Appl. No.: 17/374,411

(22) Filed: Jul. 13, 2021

(65) Prior Publication Data

US 2022/0026109 A1 Jan. 27, 2022

(30) Foreign Application Priority Data

Jul. 27, 2020 (KR) ..... 10-2020-0092815

(51) Int. Cl.

| | |
|---|---|
| ***F24H 9/20*** | (2022.01) |
| ***F24H 9/02*** | (2006.01) |
| ***F24H 1/14*** | (2022.01) |
| ***F23M 5/00*** | (2006.01) |

(Continued)

(52) U.S. Cl.

CPC ..... *F24H 9/02* (2013.01); *F23M 5/00* (2013.01); *F24H 1/145* (2013.01); *F24H 9/139* (2022.01); *F24H 9/1836* (2013.01); *F24H 9/2035* (2013.01)

(58) Field of Classification Search

CPC ..... F24H 9/02; F24H 9/139; F24H 9/1836; F24H 9/146; F24H 9/2035; F24H 1/145; F23M 5/00; F23M 5/08; C03B 5/44; F23G 2203/205

See application file for complete search history.

(56) References Cited

U.S. PATENT DOCUMENTS

| | | | | |
|---|---|---|---|---|
| 3,920,067 | A | 11/1975 | Schindler | F24H 1/145 122/406.1 |
| 10,393,404 | B2 | 8/2019 | Kondo et al. | |
| 10,481,012 | B2 | 11/2019 | Nagasaka | F24H 9/2035 |

(Continued)

FOREIGN PATENT DOCUMENTS

| | | |
|---|---|---|
| CN | 1553115 A | 12/2004 |
| CN | 108603688 A | 9/2018 |

(Continued)

*Primary Examiner* — Gregory A Wilson

(57) ABSTRACT

An aspect of the present disclosure provides a flow channel cap plate that constitutes a combustion chamber assembly including a combustion chamber and a plurality of insulating pipelines disposed on left/right side surfaces of the combustion chamber, the flow channel cap plate forming an insulating flow channel by covering the front surface of the combustion chamber, the flow channel cap plate including an inlet part including an inlet, and an inlet flow channel cap covering the front surface of the combustion chamber, an inlet space part is formed by covering the front surface of the combustion chamber with the inlet flow channel cap, the inlet is an entrance of the insulating flow channel, the plurality of insulating pipelines include a plurality of inlet insulating pipelines, and the inlet space part is a space that communicates the inlet with the plurality of inlet insulating pipelines.

10 Claims, 7 Drawing Sheets

(51) Int. Cl.
*F24H 9/1836* (2022.01)
*F24H 9/13* (2022.01)

(56) References Cited

U.S. PATENT DOCUMENTS

| | | | | |
|---|---|---|---|---|
| 10,612,776 | B2 | 4/2020 | Ono | F24H 9/148 |
| 10,767,901 | B2 | 9/2020 | Ono | F24H 9/1836 |
| 10,900,692 | B2 | 1/2021 | Le Mer | |
| 10,928,063 | B2 | 2/2021 | Ono | F23D 14/02 |
| 11,022,342 | B2 | 6/2021 | Kondo | F24H 8/00 |
| 11,448,472 | B2 | 9/2022 | Jeong et al. | |
| 11,585,572 | B2 | 2/2023 | Park et al. | |
| 2018/0087806 | A1 | 3/2018 | Kondo et al. | |
| 2018/0119989 | A1 | 5/2018 | Wada | |
| 2018/0216848 | A1 | 8/2018 | Jeong | |
| 2018/0224337 | A1 | 8/2018 | Nagasaka et al. | |
| 2018/0372311 | A1 | 12/2018 | Ono et al. | |
| 2019/0049148 | A1 | 2/2019 | Le Mer | |
| 2020/0072504 | A1 | 3/2020 | Goto | F28F 9/002 |
| 2020/0208875 | A1 | 7/2020 | Jeong et al. | |
| 2021/0072093 | A1 | 3/2021 | Park | G01K 1/143 |
| 2021/0247103 | A1 | 8/2021 | Park et al. | |
| 2022/0026109 | A1 | 1/2022 | Park | F24H 1/145 |
| 2022/0074669 | A1 | 3/2022 | Gullapalli | F24H 15/219 |

FOREIGN PATENT DOCUMENTS

| | | | |
|---|---|---|---|
| CN | 113108465 | A | 7/2021 |
| EP | 3674647 | A | 7/2020 |
| JP | 2018-128197 | A | 8/2016 |
| JP | 2018-054155 | A | 4/2018 |
| JP | 2018-071854 | A | 5/2018 |
| KR | 10-2009-0047901 | A | 5/2009 |
| KR | 10-20150134177 | A | 12/2015 |
| KR | 10-2018-0007933 | A | 1/2018 |
| KR | 10-2019-0138553 | A | 12/2019 |

FLOW CHANNEL CAP PLATE AND COMBUSTION CHAMBER ASSEMBLY INCLUDING THE SAME

CROSS-REFERENCE TO RELATED APPLICATION

This application claims the benefit of priority to Korean Patent Application No. 10-2020-0092815, filed in the Korean Intellectual Property Office on Jul. 27, 2020, the entire contents of which are incorporated herein by reference.

TECHNICAL FIELD

The present disclosure relates to a flow channel cap plate and a combustion chamber assembly including the same.

BACKGROUND

A water heater that heats water to discharge warmed water or for heating generally achieve its object by receiving a fuel, burning the fuel, and transferring heat generated therefrom to water.

A combustion reaction is induced by using a burner to generate heat from a water heater. When the combustion reaction occurs, flame and combustion gas are generated as side-products. Because the durability of a heat exchanger may be seriously deteriorated when heat is transferred in a scheme, in which flame directly contacts the heat exchanger, in which the heating water flows, heat is transferred to the heating water flowing in the heat exchanger mainly by using the combustion gas.

Then, the combustion gas may be disposed between the burner and the heat exchanger such that the flame does not directly reach the heat exchanger. The flame may be located inside the combustion chamber. Because the flame is located inside the combustion chamber, the combustion chamber may be heated to a very high temperature. The combustion chamber is heated to a high temperature so that the material that constitutes the combustion chamber may be deformed, and a person who contacts the combustion chamber from the outside may be burned.

Accordingly, various insulation means may be used for the combustion chamber. The insulation means may include a method for causing heating water to flow along pipelines disposed around a combustion chamber. However, when the flow channel, in which the heating water flows, is long or has many parts that change the directions of the flows of the heating water, a pressure drop due to loss of the pressure of the heating water may occur so that the heating water may not circulate smoothly.

SUMMARY

The present disclosure has been made to solve the above-mentioned problems occurring in the prior art while advantages achieved by the prior art are maintained intact.

An aspect of the present disclosure provides a flow channel cap plate that achieves a reduced pressure loss and an excellent insulation performance, and a combustion chamber assembly including the same.

The technical problems to be solved by the present inventive concept are not limited to the aforementioned problems, and any other technical problems not mentioned herein will be clearly understood from the following description by those skilled in the art to which the present disclosure pertains.

According to an aspect of the present disclosure, there is provided a flow channel cap plate that constitutes a combustion chamber assembly including a combustion chamber configured such that a combustion reaction occurs in an interior thereof and a plurality of insulating pipelines disposed on left and right side surfaces of the combustion chamber and through which heating water flows forwards and rearwards, the flow channel cap plate forming an insulating flow channel, through which the heating water flows from a front surface of the combustion chamber along a periphery of the combustion chamber, by covering the front surface of the combustion chamber, the flow channel cap plate including an inlet part including an inlet, though which the heating water is introduced, and an inlet flow channel cap covering the front surface of the combustion chamber, an inlet space part is formed by covering the front surface of the combustion chamber with the inlet flow channel cap, the inlet is an entrance of the insulating flow channel, the plurality of insulating pipelines include a plurality of inlet insulating pipelines, and the inlet space part is a space that communicates the inlet with the plurality of inlet insulating pipelines such that the heating water is introduced into the inlet, is distributed to the plurality of inlet insulating pipelines, and is discharged.

According to another aspect of the present disclosure, there is provided a combustion chamber assembly including a combustion chamber configured such that a combustion reaction occurs in an interior space thereof, an inlet insulating pipeline and an outlet insulating pipeline disposed on left and right surfaces of the combustion chamber, respectively, such that heating water flows to insulate the combustion chamber, and a flow channel cap plate forming an inlet space part, in which the heating water that is to be delivered to the inlet insulating pipeline flows, by covering a front surface of the combustion chamber, and the flow channel cap plate contacts the front surface of the combustion chamber such that the inlet space part forms a ring shape when viewed from a front side to a rear side.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
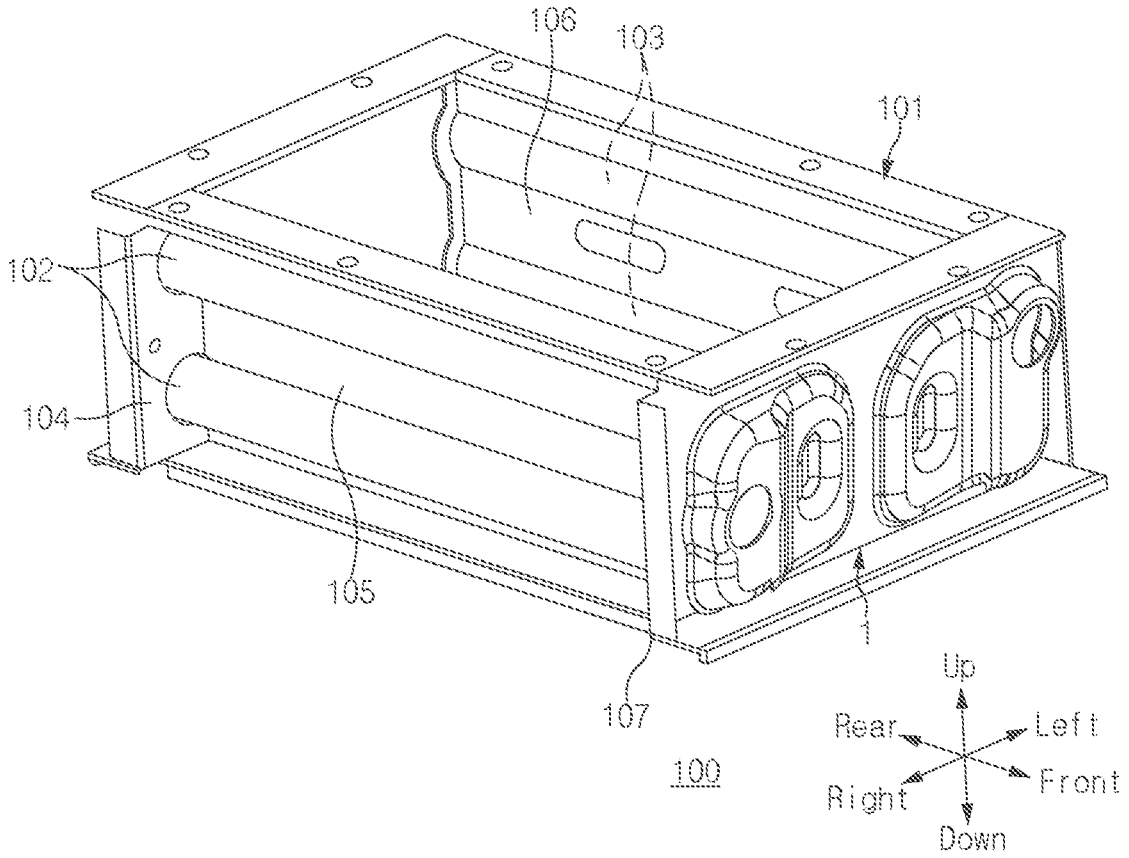
FIG. 1 is a perspective view of a combustion chamber assembly, in which a flow channel cap plate is used, according to an embodiment of the present disclosure.

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiment of the present disclosure, a detailed description of the related known configuration or function will be omitted when it is determined that it interferes with the understanding of the embodiment of the present disclosure.

In describing the components of the embodiment according to the present disclosure, terms such as first, second, A, B, (a), (b), and the like may be used. These terms are merely intended to distinguish the components from other components, and the terms do not limit the nature, order or sequence of the components. Unless otherwise defined, all terms including technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a perspective view of a combustion chamber assembly 100, in which a flow channel cap plate 1 is used, according to an embodiment of the present disclosure.

Referring to the drawing, a combustion chamber assembly 100 according to an embodiment of the present disclosure includes a combustion chamber 101, combustion chamber (101) insulating pipelines 102 and 103, and a flow channel cap plate 1. The combustion chamber assembly 100 is an element of a boiler that is provided for heating or the like through heating of heating water, and may constitute a boiler together with a burner that receives a fuel and air and generates a combustion reaction, a heat exchanger configured to exchange heat between a combustion gas generated by the combustion reaction and the heating water, and the like.

In the specification, the forward/rearward, leftward/rightward, and upward/downward directions are referred for convenience of description, and may be directions that are perpendicular to each other. However, the directions are determined relatively with respect to the direction, in which the combustion chamber assembly 100 including the flow channel cap plate 1 is disposed, and the upward/downward direction may not always refer to the vertical direction.

The combustion chamber 101 is a part configured such that a combustion reaction occurs in an interior space thereof, and opposite sides of the combustion chamber 101 may be opened along the direction, in which the combustion gas flows, as illustrated. In the application, the combustion chamber 101, the upper and lower sides of which are opened, with an assumption that the direction, in which the combustion gas flows, is the upward/downward direction, but the direction is not limited thereto. For example, in a downstream type boiler, a burner may be disposed on the upper side of the combustion chamber 101 and a heat exchanger may be disposed on the lower side of the combustion chamber 101. The heat generated by the burner and the combustion gas may be delivered to the heat exchanger through the combustion chamber 101.

A plurality of insulating pipelines 102 and 103, through which the heating water flows forwards and rearwards, may be disposed on opposite left and right side surfaces 105 and 106 of the combustion chamber 101. The insulating pipelines 102 and 103 are pipe type elements configured to insulating the combustion chamber 101 as the heating water flows. The insulating pipelines 102 and 103 may have a shape that extends forwards and downwards such that the heating water flows forwards and rearwards. The insulating pipelines 102 and 103 may pass through the front surface 107 and rear surface 104 of the combustion chamber 101, and may be adhered to the opposite left side surface 106 and right side surface 105 of the combustion chamber 101 and be fixed to the combustion chamber 101. Here, insulation prevents heat transfer, and generally refers to absorption of calorie discharged from a location to the outside such that the heat is closed at the location and the calorie finally discharged to the outside decreases than before.

The insulating pipelines 102 and 103 include an inlet insulating pipeline 102 and an outlet insulating pipeline 103. The inlet insulating pipeline 102 receives the heating water from a front end thereof through the flow channel cap plate 1 for insulation. The outlet insulating pipeline 103 receives the heating water from a rear end thereof such that the heating water flows to the flow channel cap plate 1 connected to the front end thereof, for insulation. In the embodiment of the present disclosure, the inlet insulating pipeline 102 is disposed on a right side surface 105 of the combustion chamber 101, and the outlet insulating pipeline 103 is disposed on a left side surface 106 of the combustion chamber 101.

A plurality of inlet insulating pipelines 102 and a plurality of outlet insulating pipelines 103 may be provided. In the embodiment of the present disclosure, it is described that two inlet insulating pipelines 102 and two outlet insulating pipelines 103 are provided, the two inlet insulating pipelines 102 are disposed to be spaced upwards and downwards apart from each other, and the two outlet insulating pipelines 103 are disposed to be spaced upwards and downwards apart from each other, the disposition is not limited thereto.

Figure 2:
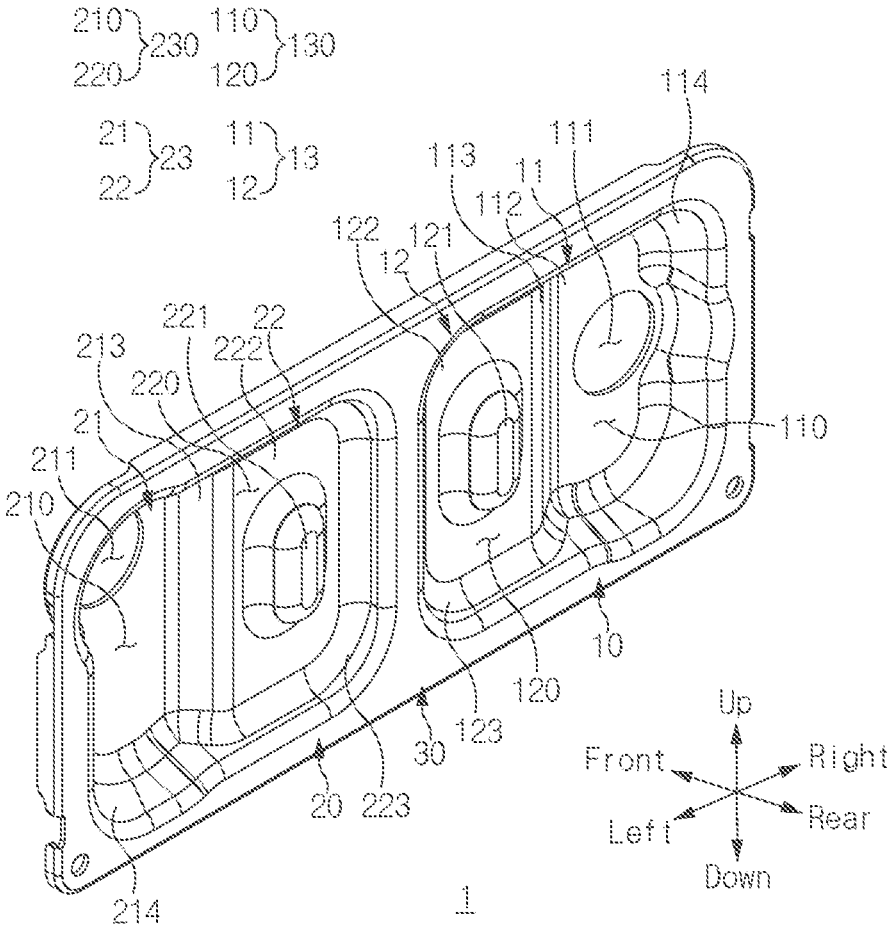
FIG. 2 is a perspective view of a flow channel cap plate according to an embodiment of the present disclosure.
Figure 3:
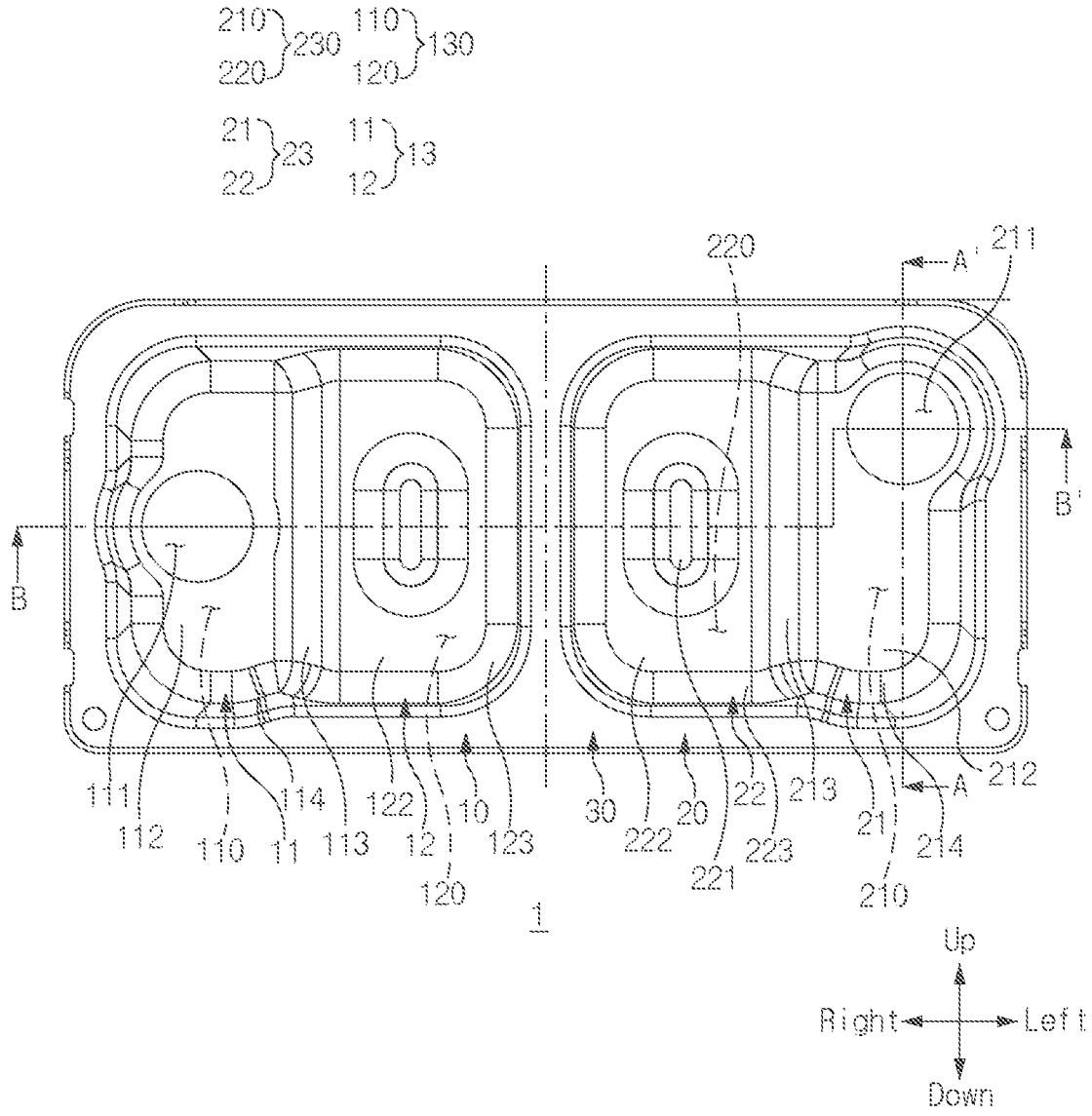
FIG. 3 is a front view of a flow channel cap plate according to an embodiment of the present disclosure.
Figure 4:
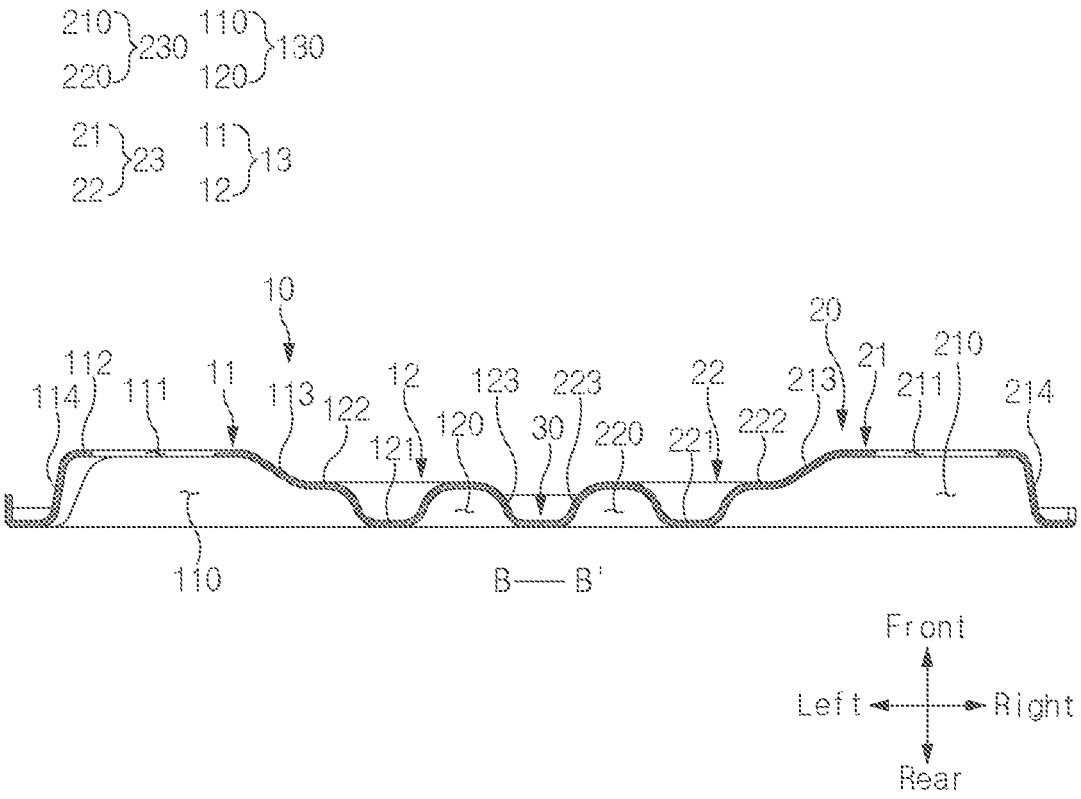
FIG. 4 is a view illustrating cross-section B-B' of FIG. 2.
Figure 5:
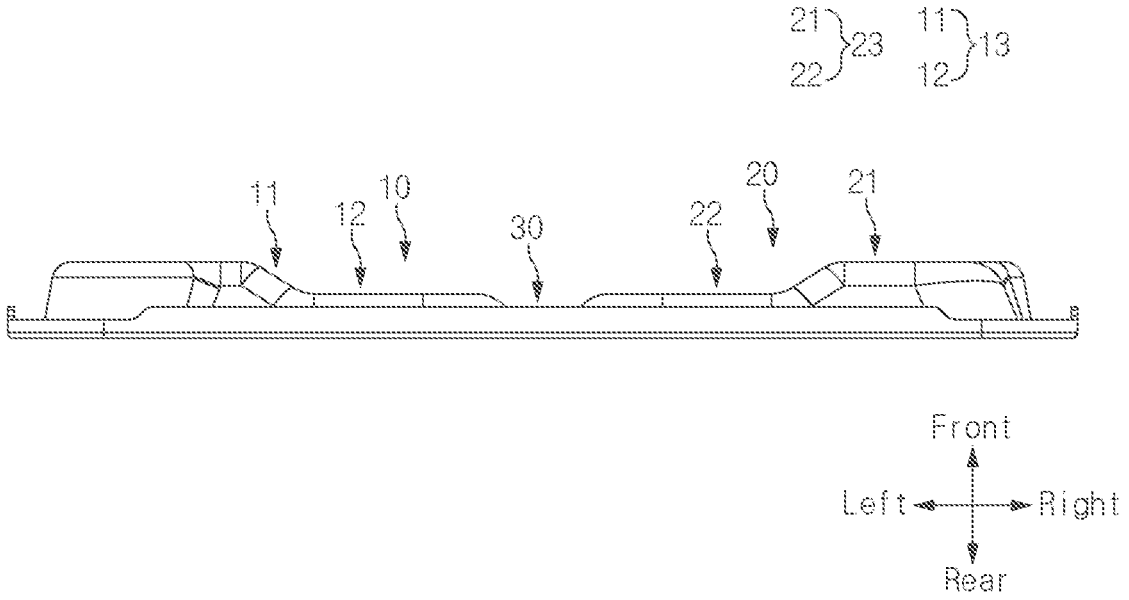
FIG. 5 is a plan view of a flow channel cap plate according to an embodiment of the present disclosure.
Figure 6:
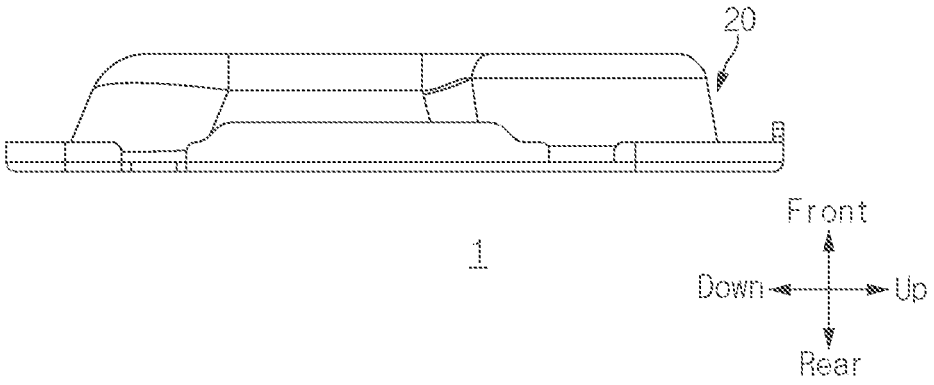
FIG. 6 is a side view of a flow channel cap plate according to an embodiment of the present disclosure.
Figure 7:
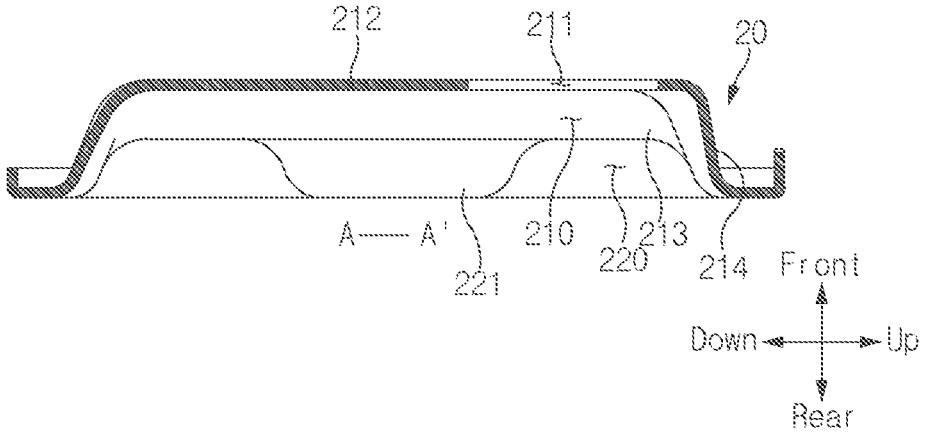
FIG. 7 is a view illustrating cross-section A-A' of a flow channel cap plate according to an embodiment of the present disclosure.

FIG. 2 is a perspective view of a flow channel cap plate 1 according to an embodiment of the present disclosure. FIG. 3 is a rear view of a flow channel cap plate 1 according to an embodiment of the present disclosure. FIG. 4 is a view illustrating cross-section B-B' of FIG. 2. FIG. 5 is a plan view of a flow channel cap plate 1 according to an embodiment of the present disclosure. FIG. 6 is a side view of a flow channel cap plate 1 according to an embodiment of the present disclosure. FIG. 7 is a view illustrating cross-section A-A' of a flow channel cap plate 1 according to an embodiment of the present disclosure.

The flow channel cap plate 1 according to the embodiment of the present disclosure is disposed to cover the front surface 107 of the combustion chamber 101. The flow channel cap plate 1 may cover the front surface 107 of the combustion chamber 101 to form an inlet space part 130, in which the heating water that is to be delivered to the inlet insulating pipeline 102 flows, and to foam an outlet space part 230, in which the heating water that is delivered from the outlet insulating pipeline 130 flows. The inlet space part 130 and the outlet space part 230 may be formed between the front surface 107 of the combustion chamber 101 and the inner surface of the flow channel cap plate 1. Because the inlet space part 130 and the outlet space part 230 are defined by the flow channel cap plate 1 and the front surface 107 of the combustion chamber 101 and the heating water may flow in the inlet space part 130 and the outlet space part 230, the front surface of the combustion chamber 101 may be insulated by the inlet space part 130 and the outlet space part 230.

The flow channel cap plate 1 may contact the front surface 107 of the combustion chamber 101 such that the inlet space part 130 forms a ring shape when viewed from the front side to the rear side. Furthermore, the flow channel cap plate 1 may contact the front surface 107 of the combustion chamber 101 such that the outlet space part 230 forms a ring shape.

A rear surface flow channel cap plate may be disposed on the rear surface 104 of the combustion chamber 101. The rear surface flow channel cap plate may form a rear surface space, in which the heating water discharged from a rear end of the inlet insulating pipeline 102 may flow, by covering the rear surface 104 of the combustion chamber 101. The rear surface space also is communicated with a rear end of the outlet insulating pipeline 103, and may be a passage for delivering the heating water from the inlet insulating pipeline 102 to the outlet insulating pipeline 103. Because the rear surface space is defined by the rear surface flow channel cap plate and the rear surface 104 of the combustion chamber 101 and the heating water may flow in the rear surface space, the rear surface of the combustion chamber 101 may be insulated by the rear surface space. That is, the heating water may perform insulation while passing through a periphery of the combustion chamber 101 once in a process of, the heating water that flows in the inlet insulating pipeline 102, being delivered from the rear surface space to the outlet insulating pipeline 103 through the inlet space part 130 formed by the flow channel cap plate 1 and in turn, being delivered to the outlet space part 230 formed by the flow channel cap plate 1 to be discharged. That is, the insulating pipelines 102 and 103 are disposed on the opposite left and right surfaces 105 and 106 of the combustion chamber 101, the flow channel cap plate 1 covers the front surface 107 of the combustion chamber 101, and the rear surface flow channel cap plate covers the rear surface 104 of the combustion chamber 101, whereby the insulating flow channel that is a flow channel, in which the heating water flows along the periphery of the combustion chamber, sequentially continuously including the front surface 107 of the combustion chamber 101, the inlet insulating pipeline 102, the rear surface 104 of the combustion chamber 101, the outlet insulating pipeline 103, and the front surface 107 of the combustion chamber. Because a plurality of inlet insulating pipelines 102 and a plurality of outlet insulating pipelines 103 are formed, the insulating flow channel may include a parallel flow channel part, in which the flow channels are formed in parallel.

The flow channel cap plate 1 may include an inlet part 10, and may include an outlet part 20 and a base part 30.

Inlet Part 10

The inlet part 10 is a portion of the flow channel cap plate 1 that forms the inlet space part 130. The inlet part 10 includes an inlet 111, through which the heating water is introduced, and an inlet flow channel cap 13 that surrounds the inlet space part 130.

The inlet 111 is an inlet of the insulating flow channel, and is formed to pass through the inlet flow channel cap 13. The inlet 111 may be connected to the heat exchanger to receive the heating water that is heated while flowing in the heat exchanger. The heating water may be introduced into the inlet space part 130 through the inlet 111.

The inlet flow channel cap 13 forms the inlet space part 130 by covering the front surface 107 of the combustion chamber 101. The inlet space part 130 is communicated with the inlet 111 and the inlet insulating pipeline 102 such that the heating water is introduced through the inlet 111 and is discharged to the inlet insulating pipeline 102. That is, the inlet space part 130 communicates the inlet 111 with the inlet insulating pipeline 102. A circumference of the inlet flow channel cap 13 contacts and is coupled to the front surface 107 of the combustion chamber 101 such that the inlet flow channel cap 13 covers the front surface 107 of the combustion chamber 101. The inlet flow channel cap 13 may be configured to form the parallel flow channel part, in which the heating water is distributed from the inlet 111 to the plurality of inlet insulating pipelines 102 via the inlet space part 130.

The inlet 111 may be formed to pass through a portion on the inlet flow channel cap 13 corresponding to the center of the plurality of inlet insulating pipelines 102 with respect to the upward/downward direction. When a pair of inlet insulating pipelines 102 are provided along the upward/downward direction, the inlet 111 may be formed to pass through a portion on the inlet flow channel cap 13, which corresponds to a middle of the pair of inlet insulating pipelines 102 with respect to the upward/downward direction. The inlet 111 is disposed at the above-described location, and the flow rate of the heating water may be prevented from being biased to any one inlet insulating pipeline 102 so that the heating water flows unevenly.

Because the inlet 111 is located between the inlets of the two inlet insulating pipelines 102, the heating water may be distributed to the inlet insulating pipelines 102 at a uniform flow rate. Even when three or more inlet insulating pipelines 102 are provided, the heating water introduced into the inlet space part 130 through the inlet 111 may be distributed and delivered to the inlet insulating pipelines 102 at similar flow rates.

The inlet flow channel cap 13 may include an inlet flow cover 11 and an inlet insulating cover 12. The inlet 111 is formed in the inlet flow cover 11, and the inlet insulating cover 12 is connected to the inlet flow cover 11. The inlet insulating cover 12 may be located on the inner side of the combustion chamber 101 than the inlet flow cover 11 with respect to the leftward/rightward direction.

The inlet flow cover 11 may be spaced apart from the front surface 107 of the combustion chamber 101 to a degree that is larger than a degree, by which the inlet insulating cover 12 is spaced forwards apart from the front surface 107 of the combustion chamber 101. Because a pressure-resistance design of forming the inlet flow cover 11 and the inlet insulating cover 12 such that distances of the inlet flow cover 11 and the inlet insulating cover 12 from the front surface 107 of the combustion chamber 101 are different, the inlet part may maintain its shape and endure a high pressure of the heating water even through the heating water of the high pressure is provided to the inlet space part 130, whereby the pressure-resistance performance may be improved. Furthermore, due to the disposition of the inlet flow cover 11 and the inlet insulating cover 12, the cross-section taken by cutting the inlet space part 130 by a plane that is perpendicular to the forward/rearward direction may increases toward the rear side. Accordingly, because the space for accommodating the water is sufficiently secured, the pressure loss of the heating water may be reduced.

The inlet flow cover 11 may include an inlet flow flattening part 112 that is perpendicular to the forward/rearward direction and is spaced apart forwards apart from the front surface 107 of the combustion chamber 101, an inlet flow side surface part 114 that connects the inlet flow flattening part 112 to the front surface 107 of the combustion chamber 101, and an inlet connection part 113 that connects the inlet flow flattening part 112 to the inlet insulating cover 12.

The inlet flow flattening part 112 may have an area that is larger than the area of the inlet 111 when viewed from the front side to the rear side. Furthermore, the inlet flow cover 11 may cover the whole front end of the inlet insulating pipeline 102, which is an inlet, when viewed from the front side to the rear side. The inlet flow space 110 that is a portion of the inlet space part 130 may be formed by the inlet flow cover 11, whereby the heating water may be distributed to the inlet insulating pipeline 102 without any big pressure loss due to the friction with the inner surface of the inlet part 10.

The inlet flow side surface part 114 and the inlet connection part 113 may extend in a direction that is inclined from a circumference of the inlet flow flattening part 112 with respect to the rear side. In the cross section of FIG. 4, in which the flow channel cap plate 1 is cut along the leftward/rightward, a degree by which the inlet flow side surface part 114 is inclined with respect to the rear side, may be larger than a degree, by which the inlet connection part 113 is inclined with respect to the rear side. However, the inlet flow side surface part 114 and the inlet connection part 113 extend in a single direction not to be formed in a flat surface but to be formed as a curved surface.

The inlet insulating cover 12 may have an inlet contact part 121 at a circumference thereof, and a location that is spaced inwards apart from the circumference thereof. The inlet insulating cover 112 may include an inlet insulating flattening part 122 that is perpendicular to the forward/rearward direction and is spaced forwards apart from the front surface 107 of the combustion chamber 101, and an inlet insulating side surface part 123 that connects the inlet insulating flattening part 122 to the front surface 107 of the combustion chamber 101. The inlet contact part 121 may be bent from the center of the inlet insulating flattening part 122 toward the rear side and contacts the front surface 107 of the combustion chamber 101 to be formed. Accordingly, the inlet insulating space 120 that is a portion of the inlet space part 130 that forms the inlet insulating cover 12 may be formed to have a ring shape, in which the inlet contact part 121 is disposed at the center thereof. The inlet contact part 121 may have a shape that extends upwards and downwards. In this way, because the inlet contact part 121 is formed such that the heating water introduced into the inlet space part 130 flows while turning to a periphery of the inlet contact part 121, a flow channel that may insulate the front surface 107 of the combustion chamber 101 may be formed.

The height of the inlet insulating flattening part 122 with respect to the upward/downward direction may be larger than the height of the inlet flow flattening part 112. Accordingly, the inlet connection part 113 connecting the inlet insulating flattening part 122 and the inlet flow flattening part 112 may have a shape, a height of which gradually increases as it goes from the inlet flow flattening part 112 to the inlet insulating flattening part 122.

Because the inlet insulating cover 12 has an embossed shape as in the inlet contact part 121, the inlet insulating cover 12 may support the pressure of the heating water introduced into the inlet space 120 while distributing the pressure of the heating water. Accordingly, the inlet insulating cover 12 may maintain its shape and endure a high pressure even when the heating water of the high pressure is introduced into the inlet space 120, whereby the pressure-resistance performance may be improved.

Outlet Part 20

The outlet part 20 is a portion of the flow channel cap plate 1 that forms the outlet space part 230. The outlet part 20 includes an outlet 211, through which the heating water is discharged, and an outlet flow channel cap 23 that surrounds the outlet space part 230.

The outlet 211 is an exit of the insulating flow channel, and is formed to pass through the outlet flow channel cap 23. The outlet 211 may be connected to a heating water flow channel, and may discharge the heating water heated via the heat exchanger and the insulating pipelines 102 and 103 for heating or the like. The heating water may be discharged from the outlet space part 230 through the outlet 211.

The outlet flow channel cap 23 forms the outlet space part 230 by covering the front surface 107 of the combustion chamber 101. The outlet space part 230 is communicated with the outlet 211 and the outlet insulating pipeline 103 such that the heating water is introduced through the outlet insulating pipeline 103 and then is discharged through the outlet 211. That is, the outlet space part 230 communicates the outlet insulating pipeline 103 with the outlet 211. A circumference of the outlet flow channel cap 23 contacts the front surface 107 of the combustion chamber 101 to be coupled thereto such that the outlet flow channel cap 23 covers the front surface 107 of the combustion chamber 101.

When a pair of outlet insulating pipelines 103 are provided along the upward/downward direction, the outlet 211 may be formed to pass through an area that is adjacent to an upper end of the outlet flow channel cap 23 with respect to the upward/downward direction. That is, the outlet 211 may be disposed on the upper side of the inlet 111. The inlet 111 may be disposed at the above-described location, and the air generated or introduced in a process of the heating water reaching the outlet space part 230 may be easily discharged through the outlet 211.

The outlet flow channel cap 23 may include an outlet flow cover 21 and an outlet insulating cover 22. The outlet 211 is formed in the outlet flow cover 21, and the outlet insulating cover 22 is connected to the outlet flow cover 21. The outlet insulating cover 22 may be located on the inner side of the combustion chamber 101 than the outlet flow cover 21 with respect to the leftward/rightward direction.

The outlet flow cover 21 may be spaced forwards apart from the front surface 107 of the combustion chamber 101 to a degree that is larger than a degree, by which the outlet insulating cover 22 is spaced forwards apart from the front surface 107 of the combustion chamber 101. The outlet flow cover 21 may include an outlet flow flattening part 212 that is perpendicular to the forward/rearward direction and is spaced forwards apart from the front surface 107 of the combustion chamber 101, an outlet flow side surface part 214 that connects the outlet flow flattening part 212 to the front surface 107 of the combustion chamber 101, and an outlet connection part 213 that connects the outlet flow flattening part 212 to the outlet insulating cover 22.

The outlet flow flattening part 212 may have an area that is larger than the area of the outlet 211 when viewed from the front side toward the rear side. Furthermore, the out flow cover 21 may cover the whole front end of the outlet insulating pipeline 103, which is an inlet, when viewed from the front side to the rear side. The outlet flow space 210 that is a portion of the outlet space part 230 may be formed by the outlet flow cover 21, whereby the heating water may be delivered from the outlet insulating pipeline 103 without any big pressure loss due to the friction with the inner surface of the outlet part 20.

The outlet flow side part 214 and the outlet connection part 213 may extend from a circumference of the outlet flow flattening part 212 in a direction that is inclined with respect to the rear side. In the cross section of FIG. 4, in which the flow channel cap plate 1 is cut along the leftward/rightward, a degree by which the outlet flow side surface part 214 is inclined with respect to the rear side, may be larger than a degree, by which the inlet connection part 113 is inclined with respect to the rear side. However, the outlet flow side surface part 214 and the outlet connection part 213 extend in a single direction not to be formed in a flat surface but to be formed as a curved surface.

The outlet insulating cover 22 may have an outlet contact part 221 at a circumference thereof, and a location that is spaced inwards apart from the circumference thereof. The outlet insulating cover 22 may include an outlet insulating flattening part 222 that is perpendicular to the forward/rearward direction and is spaced forwards apart from the front surface 107 of the combustion chamber 101, and an outlet insulating side surface part 223 that connects the outlet insulating flattening part 222 to the front surface 107 of the combustion chamber 101. The outlet contact part 221 may be bent from the center of the outlet insulating flattening part 222 toward the rear side and contacts the front surface 107 of the combustion chamber 101 to be formed. Accordingly, the outlet insulating space 220 that is a portion of the outlet space part 230 that forms the outlet insulating cover 22 may be formed to have a ring shape, in which the outlet contact part 221 is disposed at the center thereof. The outlet contact part 221 may have a shape that extends upwards and downwards. In this way, because the outlet contact part 221 is formed such that the heating water introduced into the outlet space part 230 flows while turning to a periphery of the outlet contact part 221, a flow channel that may insulate the front surface of the combustion chamber 101 may be formed.

The height of the outlet insulating flattening part 222 with respect to the upward/downward direction may be larger than the height of the outlet flow flattening part 212. Accordingly, the outlet connection part 213 that connects the outlet insulating flattening part 222 and the outlet flow flattening part 212 may have a shape, a height of which gradually increases as it goes from the outlet flow flattening part 212 toward the outlet insulating flattening part 222 when viewed from the front side to the rear side.

The flow channel cap plate 1 may include a base part 30. Because the base part 30 may be coupled to the inlet part 10 and the outlet part 20, the two parts may be connected to each other and are coupled to the front surface 107 of the combustion chamber 101 by using a coupling tool or the like, whereby the inlet part 10 and the outlet part 20 may be firmly fixed to the front surface 107 of the combustion chamber 101.

Accordingly, pressure loss is reduced in a process of the heating water flowing through the combustion chamber insulating pipeline.

The pressure-resistance performance of the flow channel cap plate enduring a pressure may be improved.

The insulation performance of the combustion chamber may be excellently maintained.

Although it may have been described until now that all the elements constituting the embodiments of the present disclosure are coupled to one or coupled to be operated, the present disclosure is not essentially limited to the embodiments. That is, without departing from the purpose of the present disclosure, all the elements may be selectively coupled into one or more elements to be operated. Furthermore, because the terms, such as "comprising", "including", or "having" may mean that the corresponding element may be included unless there is a specially contradictory description, it should be construed that another element is not extruded but may be further included. In addition, unless defined otherwise, all terms used herein, including technical or scientific terms, have the same meanings as those generally understood by those skilled in the art to which the present disclosure pertains. The terms, such as the terms defined in dictionaries, which are generally used, should be construed to coincide with the context meanings of the related technologies, and are not construed as ideal or excessively formal meanings unless explicitly defined in the present disclosure.

The above description is a simple exemplification of the technical spirits of the present disclosure, and the present disclosure may be variously corrected and modified by those skilled in the art to which the present disclosure pertains without departing from the essential features of the present disclosure. Accordingly, the embodiments disclosed in the present disclosure is not provided to limit the technical spirits of the present disclosure but provided to describe the present disclosure, and the scope of the technical spirits of the present disclosure is not limited by the embodiments. Accordingly, the technical scope of the present disclosure should be construed by the attached claims, and all the technical spirits within the equivalent ranges fall within the scope of the present disclosure.

What is claimed is:

1. A flow channel cap plate that constitutes a combustion chamber assembly including a combustion chamber configured such that a combustion reaction occurs in an interior thereof and a plurality of insulating pipelines disposed on left and right side surfaces of the combustion chamber and through which heating water flows forwards and rearwards, the flow channel cap plate forming an insulating flow channel, through which the heating water flows from a front surface of the combustion chamber along a periphery of the combustion chamber, by covering the front surface of the combustion chamber, the flow channel cap plate comprising:

an inlet part including an inlet, through which the heating water is introduced, and an inlet flow channel cap covering the front surface of the combustion chamber, wherein an inlet space part is formed by covering the front surface of the combustion chamber with the inlet flow channel cap, wherein the inlet is an entrance of the insulating flow channel, wherein the plurality of insulating pipelines include a plurality of inlet insulating pipelines, wherein the inlet space part is a space that communicates the inlet with the plurality of inlet insulating pipelines such that the heating water is introduced into the inlet, is distributed to the plurality of inlet insulating pipelines, and is discharged, wherein the inlet flow channel cap includes an inlet flow cover having the inlet and an inlet insulating cover connected to the inlet flow cover, and wherein the inlet flow cover is spaced forwards apart from the front surface of the combustion chamber to a front side by a degree that is larger than a degree, by which the inlet insulating cover is spaced apart forwards from the front surface of the combustion chamber to the front side, such that a cross-section of the inlet space part becomes larger as it becomes closer to the front surface of the combustion chamber.

2. The flow channel cap plate of claim 1, wherein the inlet is disposed at a portion on the inlet flow channel cap corresponding to a center of the plurality of inlet insulating pipelines with respect to an upward/downward direction such that the cooling water is distributed along the upward/downward direction to reach the plurality of inlet insulating pipelines.

3. The flow channel cap plate of claim 1, wherein the inlet insulating cover has an inlet contact part at a circumference thereof and a location that is spaced inwards apart from the circumference, and wherein the inlet contact part contacts the front surface of the combustion chamber.

4. The flow channel cap plate of claim 3, wherein the inlet insulating cover is disposed on an inner side of the combustion chamber than a location, at which the inlet flow cover is disposed, with respect to a leftward/rightward direction.

5. The flow channel cap plate of claim 3, wherein the inlet contact part has a shape that extends upwards and downwards.

6. A flow channel cap plate that constitutes a combustion chamber assembly including a combustion chamber configured such that a combustion reaction occurs in an interior thereof and a plurality of insulating pipelines disposed on left and right side surfaces of the combustion chamber and through which heating water flows forwards and rearwards, the flow channel cap plate forming an insulating flow channel, through which the heating water flows from a front surface of the combustion chamber along a periphery of the combustion chamber, by covering the front surface of the combustion chamber, the flow channel cap plate comprising:

an inlet part including an inlet, through which the heating water is introduced, and an inlet flow channel cap covering the front surface of the combustion chamber; and an outlet part including an outlet being an exit of the insulating flow channel and from which the heating water is discharged, and an outlet flow channel cap forming an outlet space part by covering the front surface of the combustion chamber, wherein an inlet space part is formed by covering the front surface of the combustion chamber with the inlet flow channel cap, wherein the inlet is an entrance of the insulating flow channel, wherein the plurality of insulating pipelines include a plurality of inlet insulating pipelines, wherein the inlet space part is a space that communicates the inlet with the plurality of inlet insulating pipelines such that the heating water is introduced into the inlet, is distributed to the plurality of inlet insulating pipelines, and is discharged, and wherein the outlet space part communicates the outlet insulating pipeline with the outlet such that the heating water is introduced from, among the plurality of insulating pipelines, an outlet insulating pipeline, and is discharged through the outlet.

7. The flow channel cap plate of claim 6, wherein the outlet is disposed in an area that is adjacent to an upper end of the outlet flow channel cap with respect to the upward/downward direction.

8. The flow channel cap plate of claim 6, further comprising:

a base part connected to the inlet part and the outlet part, coupled to the front surface of the combustion chamber, and fixing the inlet part and the outlet part to the combustion chamber.

9. A flow channel cap plate that constitutes a combustion chamber assembly including a combustion chamber configured such that a combustion reaction occurs in an interior thereof and a plurality of insulating pipelines disposed on left and right side surfaces of the combustion chamber and through which heating water flows forwards and rearwards, the flow channel cap plate forming an insulating flow channel, through which the heating water flows from a front surface of the combustion chamber along a periphery of the combustion chamber, by covering the front surface of the combustion chamber, the flow channel cap plate comprising:

an inlet part including an inlet, through which the heating water is introduced, and an inlet flow channel cap covering the front surface of the combustion chamber, wherein an inlet space part is formed by covering the front surface of the combustion chamber with the inlet flow channel cap, wherein the inlet is an entrance of the insulating flow channel, wherein the plurality of insulating pipelines include a plurality of inlet insulating pipelines, wherein the inlet space part is a space that communicates the inlet with the plurality of inlet insulating pipelines such that the heating water is introduced into the inlet, is distributed to the plurality of inlet insulating pipelines, and is discharged, and wherein the inlet flow channel cap is configured to form a parallel flow channel part, in which the heating water is distributed from the inlet to the plurality of inlet insulating pipelines via the inlet space part.

10. A combustion chamber assembly comprising:

a combustion chamber configured such that a combustion reaction occurs in an interior space thereof;

an inlet insulating pipeline and an outlet insulating pipeline disposed on left and right surfaces of the combustion chamber, respectively, such that heating water flows to insulate the combustion chamber; and a flow channel cap plate including an inlet flow channel cap forming an inlet space part, in which the heating water that is to be delivered to the inlet insulating pipeline flows, by covering a front surface of the combustion chamber, wherein the flow channel cap plate contacts the front surface of the combustion chamber such that the inlet space part forms a ring shape when viewed from a front side to a rear side, wherein the inlet flow channel cap includes an inlet flow cover in which a inlet is formed and an inlet insulating cover connected to the inlet flow cover, and wherein the inlet flow cover is spaced forwards apart from the front surface of the combustion chamber to a front side by a degree that is larger than a degree, by which the inlet insulating cover is spaced apart forwards from the front surface of the combustion chamber to the front side, such that a cross-section of the inlet space part becomes larger as it becomes closer to the front surface of the combustion chamber.

* * * * *